US011330373B2

(12) United States Patent
Shigeta et al.

(10) Patent No.: US 11,330,373 B2
(45) Date of Patent: May 10, 2022

(54) DOME TYPE DIAPHRAGM, BALANCED DOME DIAPHRAGM, AND SPEAKER

(71) Applicant: JVCKENWOOD Corporation, Yokohama (JP)

(72) Inventors: Akira Shigeta, Yokohama (JP); Tomoaki Ogata, Yokohama (JP); Kazuyuki Inagaki, Yokohama (JP)

(73) Assignee: JVCKENWOOD CORPORATION, Kanagawa (JP)

( * ) Notice: Subject to any disclaimer, the term of this patent is extended or adjusted under 35 U.S.C. 154(b) by 0 days.

(21) Appl. No.: 16/714,409

(22) Filed: Dec. 13, 2019

(65) Prior Publication Data

US 2020/0304918 A1 Sep. 24, 2020

(30) Foreign Application Priority Data

Mar. 22, 2019 (JP) ..... JP2019-054885

(51) Int. Cl.
*H04R 7/12* (2006.01)
*H04R 1/28* (2006.01)

(52) U.S. Cl.
CPC ..... *H04R 7/127* (2013.01); *H04R 1/2834* (2013.01)

(58) Field of Classification Search
CPC ..... H04R 7/12–127
USPC ..... 381/430
See application file for complete search history.

(56) References Cited

U.S. PATENT DOCUMENTS 2,003,908 A * 6/1935 Smith ..... H04R 7/127 181/167
3,513,270 A * 5/1970 Warning ..... H04R 7/127 381/424
5,150,419 A * 9/1992 Kizak ..... H04R 1/025 381/412
5,471,437 A * 11/1995 Schutter ..... H04R 9/00 181/163
8,620,017 B2 * 12/2013 Konuma ..... H04R 9/045 381/407
2004/0213431 A1 * 10/2004 Mello ..... H04R 7/18 381/430
2005/0259843 A1 * 11/2005 Horigome ..... H04R 7/127 381/430
2015/0117698 A1 * 4/2015 Bullimore ..... H04R 7/16 381/398
2021/0321199 A1 * 10/2021 Cheng ..... H04R 7/18

FOREIGN PATENT DOCUMENTS

JP 2012-44352 A 3/2012

OTHER PUBLICATIONS

JVCKENWOOD Exhibits at CES 2019; Dec. 28, 2018; 3 pages.

* cited by examiner

*Primary Examiner* — Suhan Ni
(74) *Attorney, Agent, or Firm* — Procopio, Cory, Hargreaves & Savitch LLP

(57) ABSTRACT

The present disclosure provides a dome type diaphragm, a balanced dome diaphragm, and a speaker capable of outputting sounds in a high sound area at a high sound pressure. A dome type diaphragm according to the present disclosure includes: a first part having a first curvature; and a second part that is arranged in an inner peripheral side of the first part and is integrally provided with the first part, the second part having a second curvature that is different from the first curvature.

11 Claims, 10 Drawing Sheets

DOME TYPE DIAPHRAGM, BALANCED DOME DIAPHRAGM, AND SPEAKER

CROSS REFERENCE TO RELATED APPLICATION

This application is based upon and claims the benefit of priority from Japanese patent application No. 2019-054885, filed on Mar. 22, 2019, the disclosure of which is incorporated herein in its entirety by reference.

STATEMENT REGARDING PRIOR DISCLOSURES BY THE INVENTORS

The inventors of the present application authored and disclosed the subject matter of the present application on Jan. 8-11, 2019 in a news release for an exhibition at the 2019 Consumer Electronics Show (CES). This prior disclosure is being submitted in an Information Disclosure Statement in the present application as "JVCKENWOOD Exhibits at CES 2019; Dec. 28, 2018; 3 pages."

BACKGROUND

The present disclosure relates to a dome type diaphragm, a balanced dome diaphragm, and a speaker.

In recent years, due to improvement in information technology and acoustic technology, sound sources including sounds in a high sound area (equal to or higher than 20 kHz) that have not been treated in conventional CDs, i.e., so-called high-resolution sound sources, have become widespread. It is therefore desired to develop speakers for reproducing high-resolution sound sources with high quality.

Japanese Unexamined Patent Application Publication No. 2012-44352 discloses a speaker that uses a cone type diaphragm. The speaker disclosed in Japanese Unexamined Patent Application Publication No. 2012-44352 uses a cone type diaphragm having a large rigidity. Japanese Unexamined Patent Application Publication No. 2012-44352 discloses that the speaker including the above configuration is able to output sounds having frequencies whose upper limits of frequency characteristics are within 5-8 kHz at a high sound pressure.

SUMMARY

It has been required to output, for example, high frequency sounds whose frequencies are, for example, equal to or larger than 20 kHz at a high sound pressure, like in a case of reproduction of a high-resolution sound source. However, there is a problem that the cone type diaphragm as disclosed in Japanese Unexamined Patent Application Publication No. 2012-44352 alone is not sufficient to output high frequency sounds of equal to or higher than 20 kHz at a high sound pressure.

Based on the aforementioned background, a balanced dome type diaphragm in which a small-sized dome type diaphragm that serves as a tweeter and a cone type diaphragm are combined with each other has been focused on.

In order to increase the frequency that can be output in the above balanced dome type diaphragm, it is required to increase a high region reproduction frequency limit in which the dome type diaphragm can vibrate. Further, in order to increase the high reproduction frequency limit in which the dome type diaphragm can vibrate, a method of decreasing the weight of the dome type diaphragm by thinning the film thickness thereof has been known. However, there is a problem that, although the film thickness of the dome type diaphragm can be reduced to some extent, it becomes difficult to maintain a sufficiently high strength if the film thickness thereof is further reduced.

A dome type diaphragm according to this embodiment includes:

a first part having a first curvature; and a second part that is arranged in an inner peripheral side of the first part and is integrally provided with the first part, the second part having a second curvature that is different from the first curvature.

BRIEF DESCRIPTION OF THE DRAWINGS

The above and other aspects, advantages and features will be more apparent from the following description of certain embodiments taken in conjunction with the accompanying drawings, in which.

DETAILED DESCRIPTION

As a result of our thorough research, the present inventors have found that a vibration mode that has not appeared in dome type diaphragms according to related art appears when a dome type diaphragm is formed by combining a part having a relatively large curvature with a part having a relatively small curvature. The dome type diaphragm, the balanced dome diaphragm, and the speaker according to the present disclosure are based on the above findings, and are capable of outputting sounds in a high sound area at a high sound pressure.

Hereinafter, with reference to the drawings, specific examples will be explained in detail. Throughout the drawings, the same or corresponding elements are denoted by the same reference symbols, and overlapping descriptions will be omitted as necessary for the sake of clarification of the description. As a matter of course, the right-handed XYZ-coordinate system shown in FIG. 1 and the other drawings is used for the sake of convenience to illustrate a positional relationship among components. In general, as is common among the drawings, a Z-axis positive direction is a vertically upward direction, and an XY-plane is a horizontal plane. Throughout this specification, the speaker and the diaphragm are arranged in such a way that a sound emitting direction in which sounds are output corresponds to the Z-axis positive direction.

Each of the embodiments described below may be used individually, or two or more of the embodiments may be appropriately combined with one another. These embodiments include novel features different from each other. Accordingly, these embodiments contribute to attaining objects or solving problems different from one another and contribute to obtaining advantages different from one another.

First Embodiment

Figure 1:
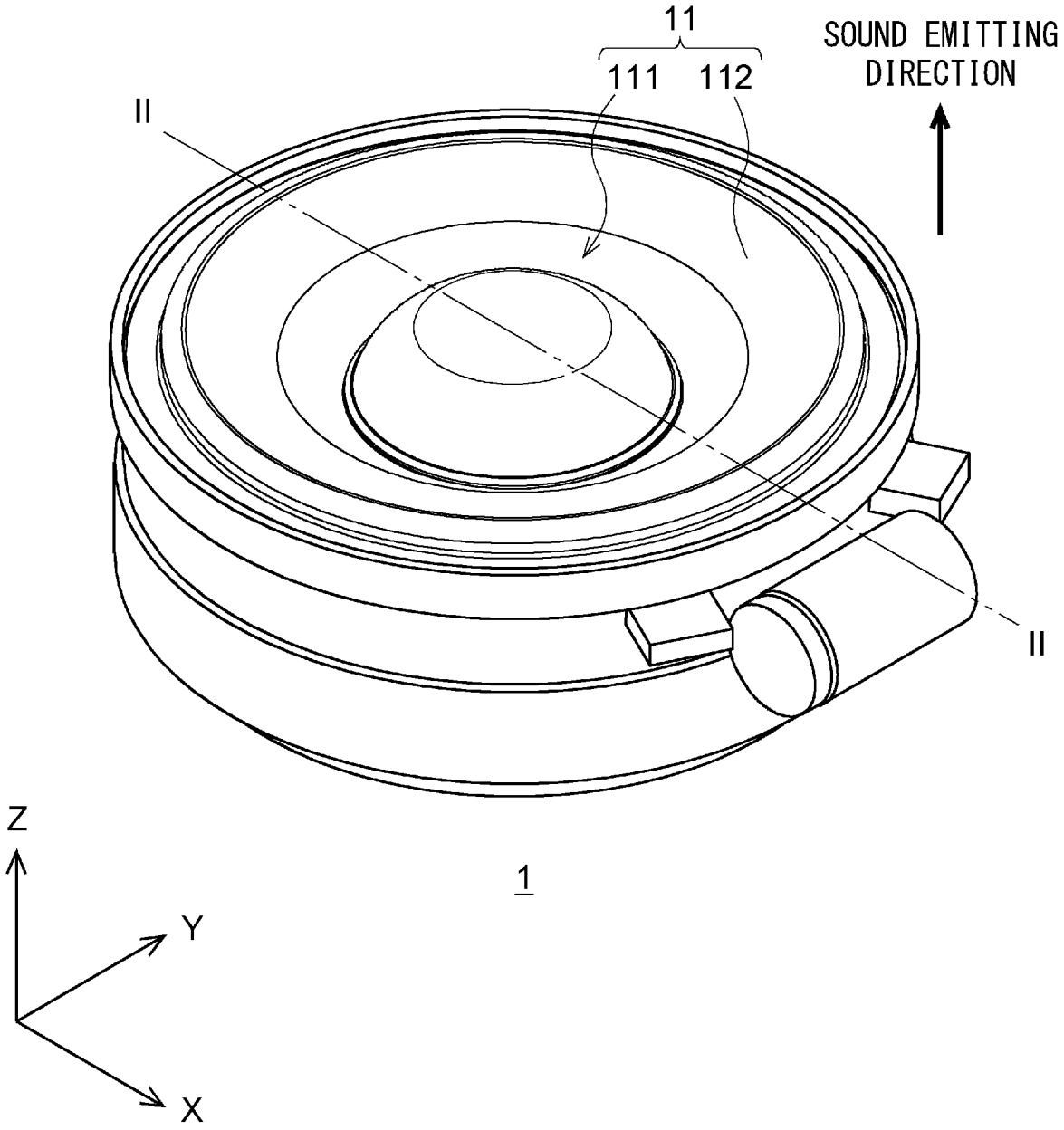
FIG. 1 is a perspective view of a speaker according to a first embodiment.
Figure 2:
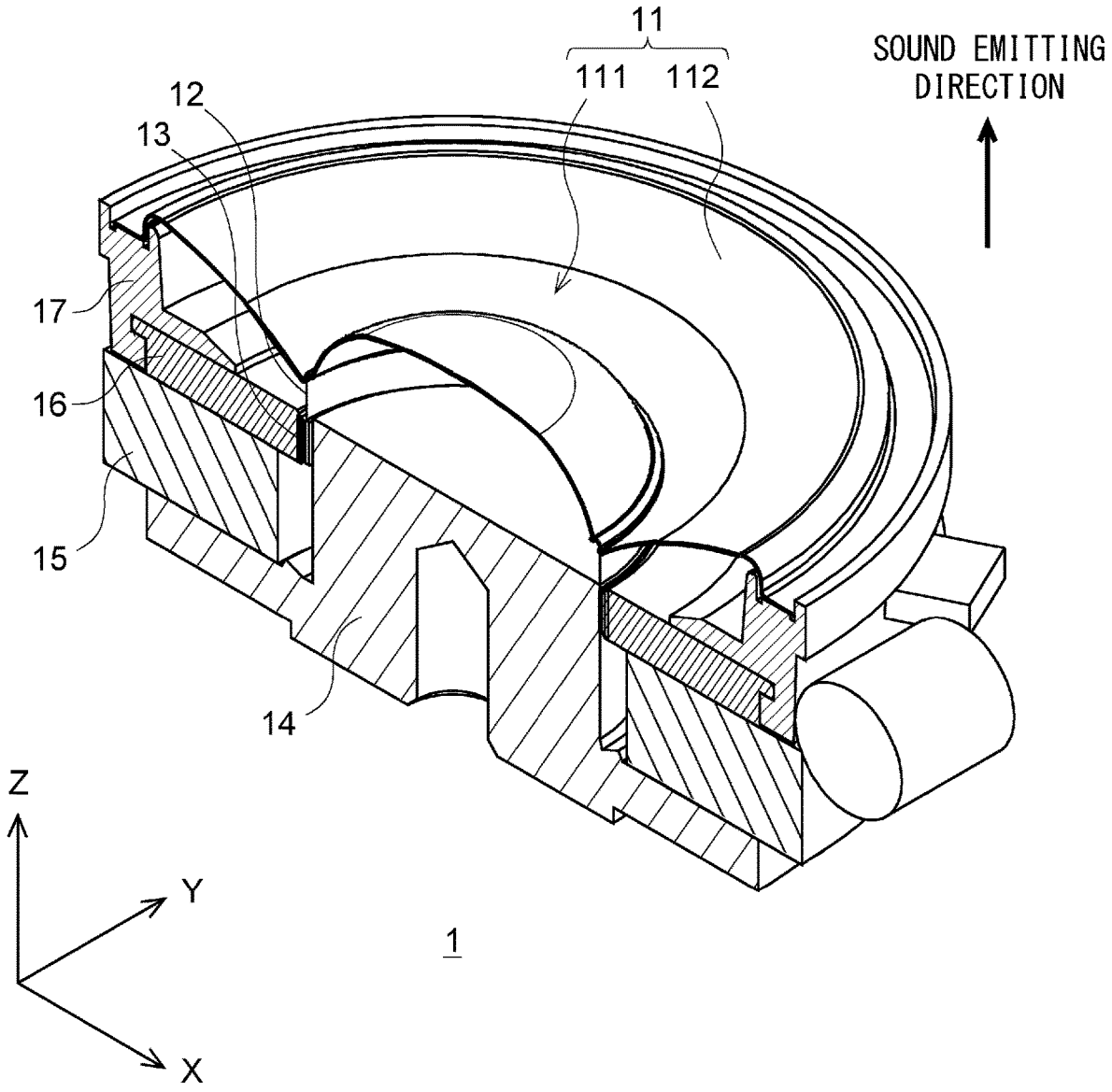
FIG. 2 is a cross-sectional perspective view of the speaker according to the first embodiment.

With reference first to FIGS. 1 and 2, a specific configuration of a speaker 1 according to a first embodiment will be explained. FIG. 1 is a perspective view of the speaker 1 according to the first embodiment. FIG. 2 is a cross-sectional perspective view of the speaker 1 shown in FIG. 1 taken along the line II-II.

As shown in FIG. 1, the speaker 1 according to this embodiment includes a diaphragm 11. Further, as shown in FIG. 2, the speaker 1 further includes a bobbin 12, a voice coil 13, a yoke 14, a magnet 15, a plate 16, and a frame 17. In this embodiment, the diaphragm 11, the bobbin 12, the voice coil 13, the yoke 14, the magnet 15, the plate 16, and the frame 17 are each formed to have a circular shape or an annular shape when they are seen from the sound emitting direction and they are concentrically formed.

The diaphragm 11 is a plate that vibrates in the sound emitting direction, thereby outputting sounds in the sound emitting direction. The diaphragm 11 is preferably formed of a highly rigid material in order to efficiently generate vibration in a high frequency band. The diaphragm 11 can be integrally formed of, for example, a high hardness fiber material such as polyetherimide (PEI), carbon fibers, or aramid fibers, or a light metal.

The diaphragm 11 shown in FIGS. 1 and 2 includes a dome type diaphragm 111 that has a convex shape in the sound emitting direction and a cone type diaphragm 112 that has a concave shape in the sound emitting direction and is provided around the dome type diaphragm 111. That is, the diaphragm 11 is described to be a balanced dome type diaphragm. Only the dome type diaphragm 111 may be provided and the cone type diaphragm 112 may not be provided. Among them, the dome type diaphragm 111 serves as a tweeter that is vibrated at a high frequency. Further, the cone type diaphragm 112 plays a role of increasing the sound pressure by vibrating in a large area. Detailed structures of the dome type diaphragm 111 will be explained later.

The diaphragm 11 may have, for example, a diameter of about 40 mm when it is seen from the sound emitting direction, although the size of the diaphragm 11 depends on the frequency band of a sound to be output. Among the components of the diaphragm 11, the dome type diaphragm 111 may have a diameter of about 20-25 mm when it is seen from the sound emitting direction. Further, the thickness of the diaphragm 11 may be about 0.05-0.1 mm.

As shown in FIG. 2, the bobbin 12 is a cylindrical core that transmits vibration to the diaphragm 11. The bobbin 12 is formed of a highly rigid material such as polyimide (PI) or glass imide. As shown in FIG. 2, the outer diameter of the bobbin 12 is formed to be substantially equal to the outer diameter of the dome type diaphragm 111. Further, an upper end of the bobbin 12 is in contact with a lower end of the dome type diaphragm 111.

In the above configuration, the bobbin 12 is vibrated in the sound emitting direction, whereby the vibration can be transmitted from the upper end of the bobbin 12 to the lower end of the diaphragm 11. Further, since the upper end of the cylindrical bobbin 12 is in contact with the lower end of the dome type diaphragm 111, the bobbin 12 is able to induce the vibration in the sound emitting direction to the dome type diaphragm 111 more strongly.

The voice coil 13 is a coil wound around the outer periphery of the bobbin 12. The voice coil 13 can be formed of a metal conductor such as a copper line or an aluminum line. The respective ends of the voice coil 13 are connected to a power supply (not shown), and the magnitude and the frequency of the current that flows through the voice coil 13 can be controlled by controlling this power supply. Due to a magnetic circuit formed of the magnet 15 or the like that will be described later and a current that flows through the voice coil 13, the bobbin 12 and the voice coil 13 receive power in the sound emitting direction, and are vibrated in accordance with the direction of the current of the voice coil 13.

An electric filter may be provided between the voice coil 13 and a power supply (not shown) in such a way that only the current whose frequency is equal to or smaller than a predetermined frequency flows through the voice coil 13. For example, capacitors having an electric capacity in accordance with the frequency band to be filtered may be connected in series between the voice coil 13 and the power supply (not shown). In the above configuration, it is possible to remove unwanted low frequency components in high frequency reproduction of current and to reproduce high frequency sounds with a high quality.

The yoke 14, which is a member that includes a columnar part extending in the sound emitting direction and a flange part that is extended from a lower end of the columnar part toward the radial direction side, is formed of a magnetic material such as iron. The outer diameter of the columnar part of the yoke 14 is formed to be slightly smaller than the inner diameter of the bobbin 12, and the upper end of the columnar part of the yoke 14 is arranged in such a way that it is on an inner side of the bobbin 12 and the voice coil 13.

The magnet 15 is an annular magnet. The magnet 15 may be, for example, a neodymium magnet. The magnet 15, which is placed on the flange part of the yoke 14, is formed so as to surround the columnar part of the yoke 14.

The annular plate 16 is provided on the magnet 15 in such a way that the annular plate 16 is opposed to the flange part of the yoke 14 with the magnet 15 interposed therebetween. The plate 16 is formed of a magnetic material such as iron.

In the above configuration, the yoke 14, the magnet 15, and the plate 16 may integrally form a magnetic circuit, and a strong magnetic field is generated from the inner diameter part of the plate 16 toward the yoke 14. The bobbin 12 and the voice coil 13 can receive power in the sound emitting direction by this magnetic field and the current that flows through the voice coil 13, and can be vibrated.

The frame 17 is an outer frame of the speaker 1. The frame 17 is formed of, for example, resin such as PI or PEI. The frame 17 supports the diaphragm 11 and the plate 16.

Figure 3:
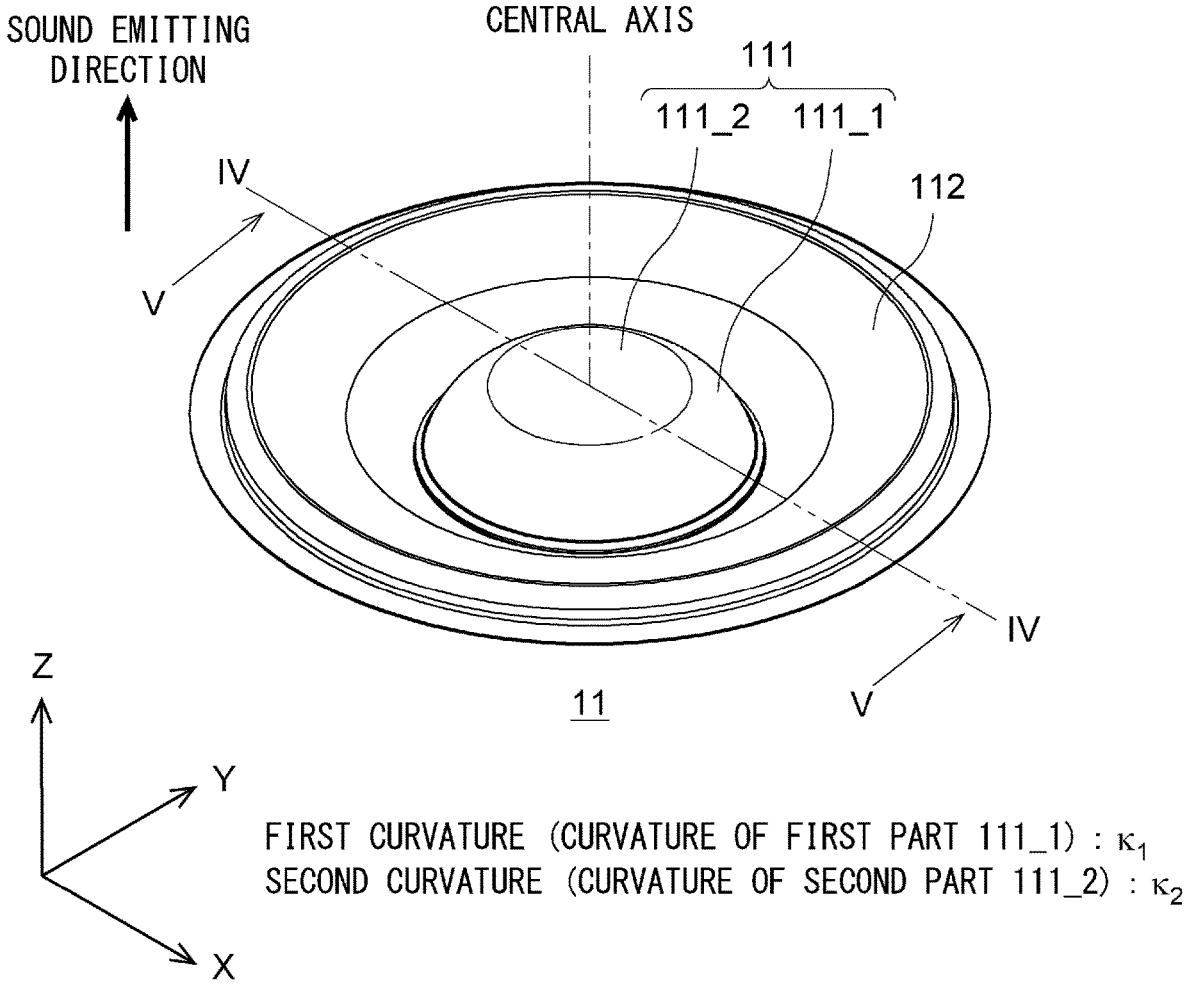
FIG. 3 is a perspective view of a diaphragm according to the first embodiment.
Figure 4:
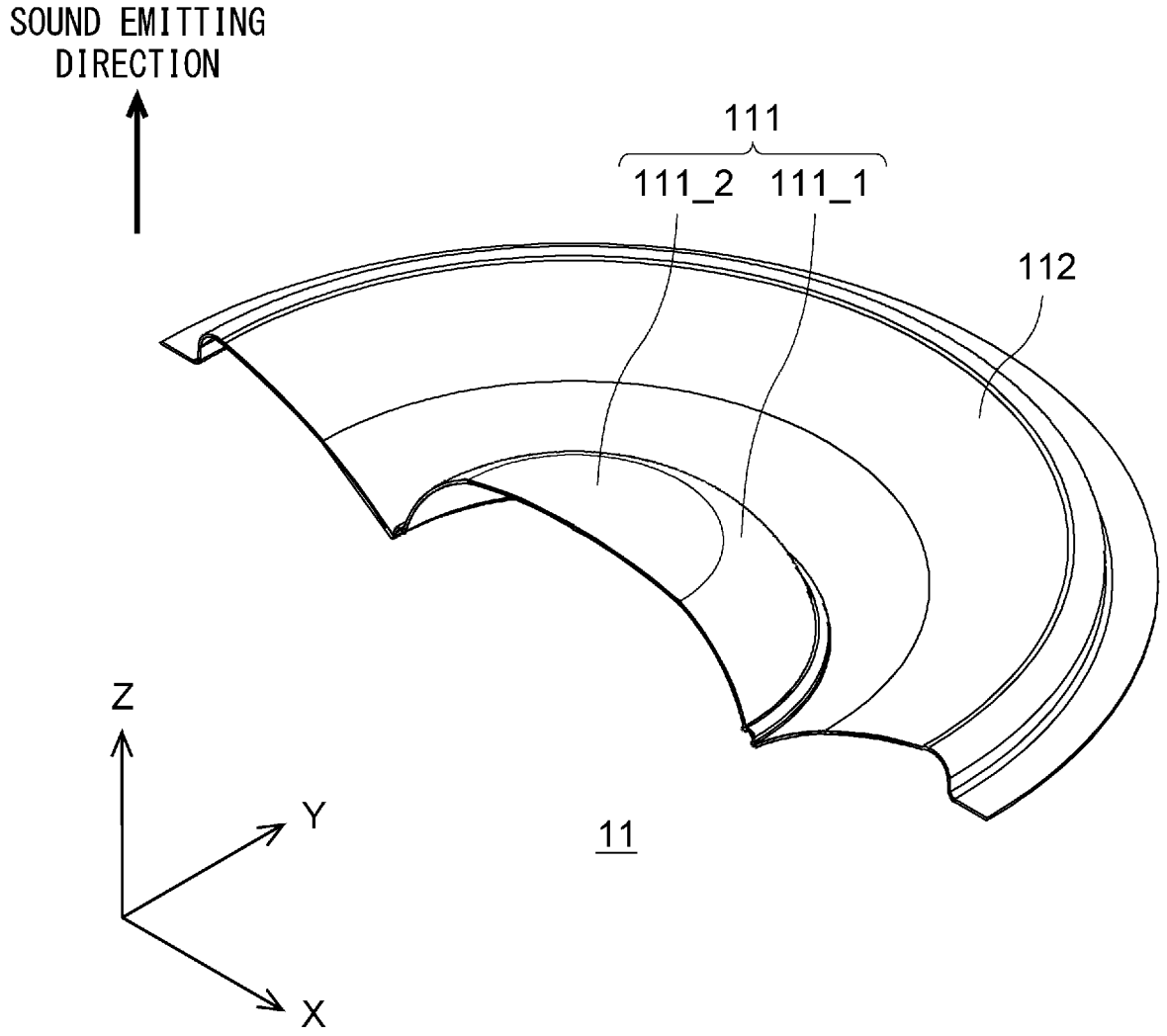
FIG. 4 is a cross-sectional perspective view of the diaphragm according to the first embodiment.
Figure 5:
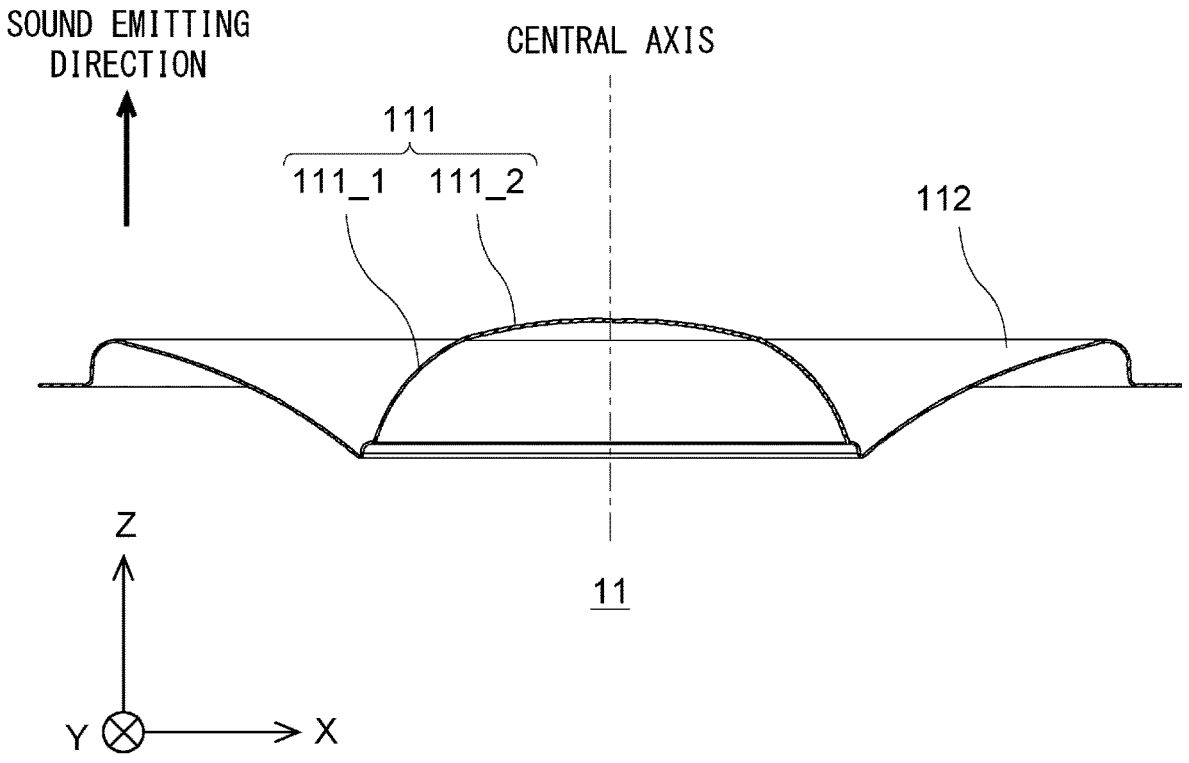
FIG. 5 is a cross-sectional horizontal view of the diaphragm according to the first embodiment.

Now, with reference to FIGS. 3 to 5, a detailed configuration of the dome type diaphragm 111 will be explained. FIG. 3 is a perspective view of the diaphragm 11 according to the first embodiment. FIG. 4 is a cross-sectional perspective view of the diaphragm 11 shown in FIG. 3 taken along the line IV-IV. FIG. 5 is a cross-sectional horizontal view of the diaphragm 11 shown in FIG. 3 when it is taken along the line IV-IV and it is seen from the Y-axis negative direction side.

As shown in FIGS. 3-5, the dome type diaphragm 111 includes a first part 111_1 having a convex shape in the sound emitting direction and a second part 111_2 that is arranged on an inner side (i.e., an inner diameter side) of the first part 111_1 and is integrally provided with the first part 111_1. The first part 111_1 has an annular shape when it is seen from the sound emitting direction, and the second part 111_2 has a circular shape when it is seen from the sound emitting direction.

In the embodiments of the present disclosure, the first part 111_1 and the second part 111_2 are provided concentrically about a central axis when they are seen from the sound emitting direction. Accordingly, the position of the boundary between the first part 111_1 and the second part 111_2 in the radial direction becomes uniform in the circumferential direction. Therefore, the vibration becomes uniform in the circumferential direction.

The first part 111_1 has a first curvature $\kappa_1$ and the second part 111_2 has a second curvature $\kappa_2$. The first curvature $\kappa_1$ is different from the second curvature $\kappa_2$. As shown in FIGS. 4 and 5, the second part 111_2 has a convex shape in the sound emitting direction and the second curvature $\kappa_2$ is smaller than the first curvature $\kappa_1$. The term curvature herein is defined to be a reciprocal of the curvature radius of its surface. The curvature of a flat plane is zero.

Since the dome type diaphragm 111 according to the present disclosure includes the first part 111_1 and the second part 111_2 having curvatures different from each other, it is possible to express the vibration mode that does not appear in a dome type diaphragm having a single curvature. That is, compared to a dome type diaphragm having a single curvature, in the cross section that passes the sound emitting axis of the diaphragm, the length from the center to the boundary between the first part 111_1 and the second part 111_2 and the distance from the boundary between the first part 111_1 and the second part 111_2 to the lower end are shorter than the distance from the center in the cross section that passes the sound emitting axis of the dome type diaphragm having a single curvature to the lower end. Therefore, the dome type diaphragm 111 according to the present disclosure capable of inducing the mode in accordance with the length is able to output sounds in a high sound area at a high sound pressure.

Figure 6:
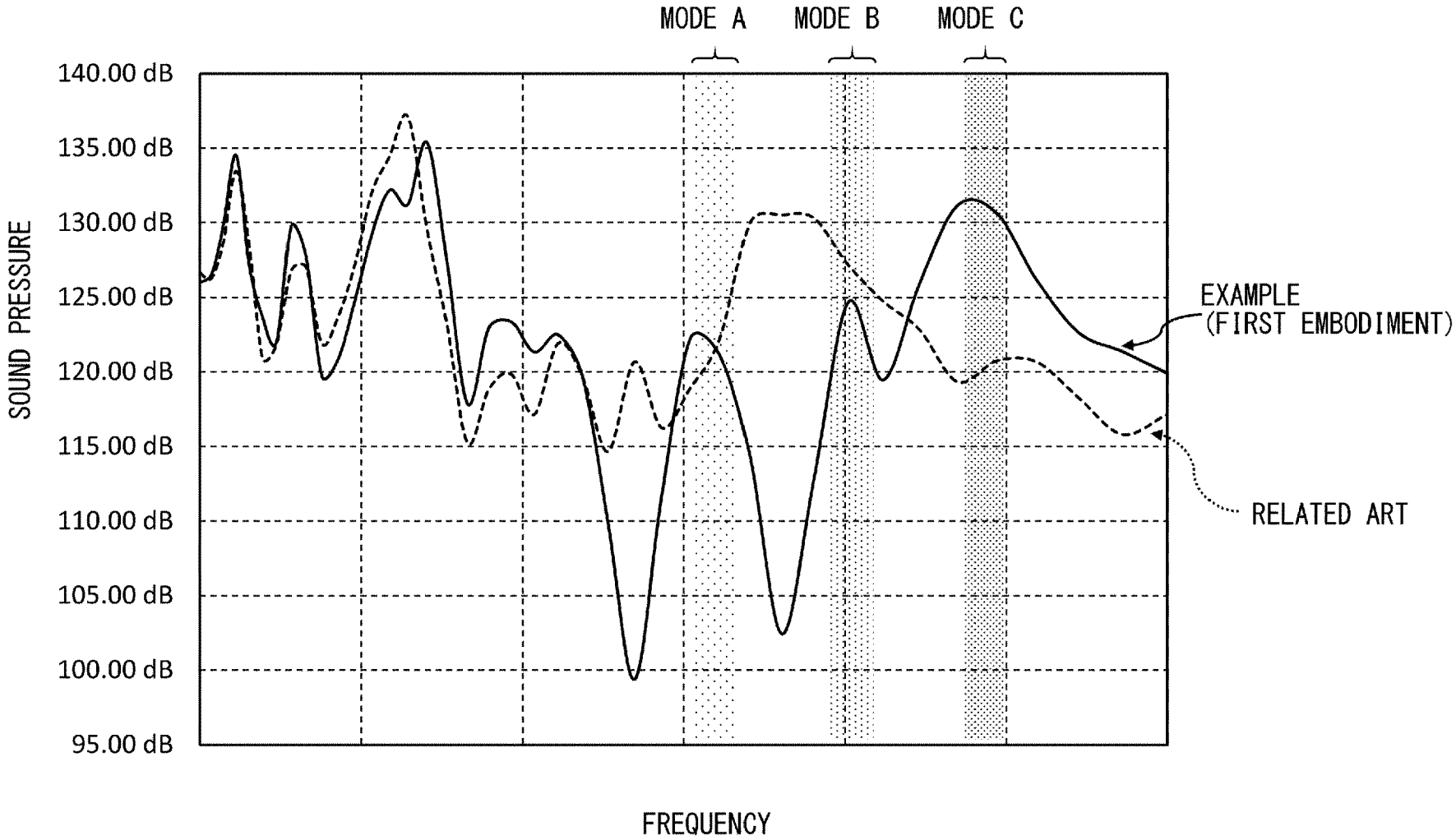
FIG. 6 is a graph indicating sound pressure-frequency characteristics of the diaphragm according to the first embodiment.

Hereinafter, effects of the present disclosure will be explained in detail using actual experimental results. FIG. 6 is a graph showing sound pressure-frequency characteristics of the diaphragm. In FIG. 6, the horizontal axis indicates the frequency and the vertical axis indicates a sound pressure at the frequency. The values in the vertical axis indicate the sound pressure at a place that is away from the diaphragm by 25 cm in the sound emitting direction. The graph of the sound pressure-frequency characteristics indicates results of a simulation by frequency response analysis.

In FIG. 6, the dashed line indicates sound pressure-frequency characteristics of a diaphragm according to related art, and the solid line indicates sound pressure-frequency characteristics of the diaphragm 11 according to this embodiment. The diaphragm according to the related art here is a balanced dome type diaphragm including a dome type diaphragm having a single curvature and a cone type diaphragm. The dimensions of the respective diaphragms are shown as follows in Table 1. The simulation has been conducted under the same conditions except for the dimensions described in Table 1. The simulation has been conducted, for example, in a situation in which the outermost periphery of the diaphragm is not vibrated and the lower end of the dome type diaphragm can be vibrated in the sound emitting axis direction.

[Table 1]

TABLE 1

| | Diameter of diaphragm seen from sound emitting direction (mm) | Diameter of dome type diaphragm seen from sound emitting direction (mm) | Curvature radius of first part (mm) | Curvature radius of second part (mm) | Radius of second part (mm) |
|---|---|---|---|---|---|
| This embodiment (solid line) | 44.0 | 20.7 | 8.0 | 20.7 | 8.0 |
| Related art (dashed line) | 44.0 | 20.7 | | 12.9 | — |

As shown in FIG. 6, in the diaphragm according to the related art, the sound pressure in the high frequency band at about 35 kHz is about 120 dB. On the other hand, in the diaphragm 11 according to this embodiment, the sound pressure in the high frequency band at about 35 kHz is 130 dB or larger.

The above results indicate that the dome type diaphragm 111 according to this embodiment is able to output sounds in a high sound area at a high sound pressure compared to the dome type diaphragm according to related art.

The reasons why the diaphragm 11 according to this embodiment is likely to output sounds in a high sound area compared to the diaphragm according to the related art may be described as follows.

First, in the dome type diaphragm 111, the first curvature $\kappa_1$ of the first part 111_1 and the second curvature $\kappa_2$ of the second part 111_2 are different from each other, and therefore the first part 111_1 and the second part 111_2 have rigidities different from each other. In this embodiment, the second curvature $\kappa_2$ is smaller than the first curvature $\kappa_1$. Therefore, the second part 111_2 has a shape that is closer to a horizontal plane than the first part 111_1 is. Therefore, the rigidity with respect to vibration in the sound emitting direction in the second part 111_2 is smaller than that in the first part 111_1. The boundary part between the first part 111_1 and the second part 111_2 serves as a mechanical filter in the transmission of the vibration.

The second part 111_2 having a relatively small rigidity resonates at a relatively high frequency band compared to the first part 111_1 having a relatively large rigidity. This mode is referred to as a mode A, which includes a high-order mode. The mode A is a mode in which only the second part 111_2 having a small rigidity is likely to vibrate. This mode is a state in which, in the direction from the lower end of the dome type diaphragm 111 toward the center thereof, vibration transmitted from the bobbin 12 to the first part 111_1 can be transmitted to the second part 111_2 since the first part 111_1 has a high rigidity.

On the other hand, the first part 111_1 resonates at a relatively low frequency band. This mode is referred to as a mode B, which includes a high-order mode. The mode B is a mode in which only the first part 111_1 is vibrated. This mode is a state in which, in the direction from the lower end of the dome type diaphragm 111 toward the center thereof, the vibration transmitted from the bobbin 12 to the first part 111_1 is reflected on the boundary part and a stationary wave is generated between the boundary part and the lower end of the dome type diaphragm 111.

Besides the mode A and the mode B, there is a mode in which both the first part 111_1 and the second part 111_2 resonate in a frequency band higher than those in the modes A and B. This mode is referred to as a mode C, which includes a high-order mode. The mode C, which is a mode in which both the first part 111_1 and the second part 111_2 are likely to be concurrently vibrated, is a mode in which the vibration of the first part 111_1 and the vibration of the second part 111_2 are smoothly connected to each other in the boundary part between the first part 111_1 and the second part 111_2.

The mode C is a mode in which the vibration transmitted from the bobbin 12 to the first part 111_1 can be transmitted to the second part 111_2 without being reflected on the boundary part in the direction from the lower end of the dome type diaphragm 111 toward the center thereof. The mode C is in a state in which the high-order mode A and the high-order mode B concurrently appear without the vibration being reflected on the boundary part while there is a difference between the rigidity of the first part 111_1 and that of the second part 111_2.

Accordingly, when the low-order modes of the respective modes are compared with one another, the appearance frequency increases in the order of the mode A, the mode B, and the mode C.

It can be considered that sounds in a high sound area can be output at a high sound pressure since a vibration mode such as the above mode C appears in the diaphragm 11 according to this embodiment. It is because, in the mode C, both the first part 111_1 and the second part 111_2 are vibrated, and the dome type diaphragm 111 can be integrally vibrated.

It is shown in FIG. 6 that the diaphragm 11 has strong vibration peaks at the frequency bands of about 25 kHz, about 30 kHz, and about 35 kHz. On the other hand, the results of the frequency response analysis show that only the second part 111_2 is vibrated at around 25 kHz, only the first part 111_1 is vibrated at around 30 kHz, and both the first part 111_1 and the second part 111_2 are vibrated at around 35 kHz.

It can be said that the above results support that the frequency bands of about 25 kHz, about 30 kHz, and about 35 kHz respectively correspond to the vibration modes of the mode A, the mode B, and the mode C.

Second Embodiment

Figure 7:
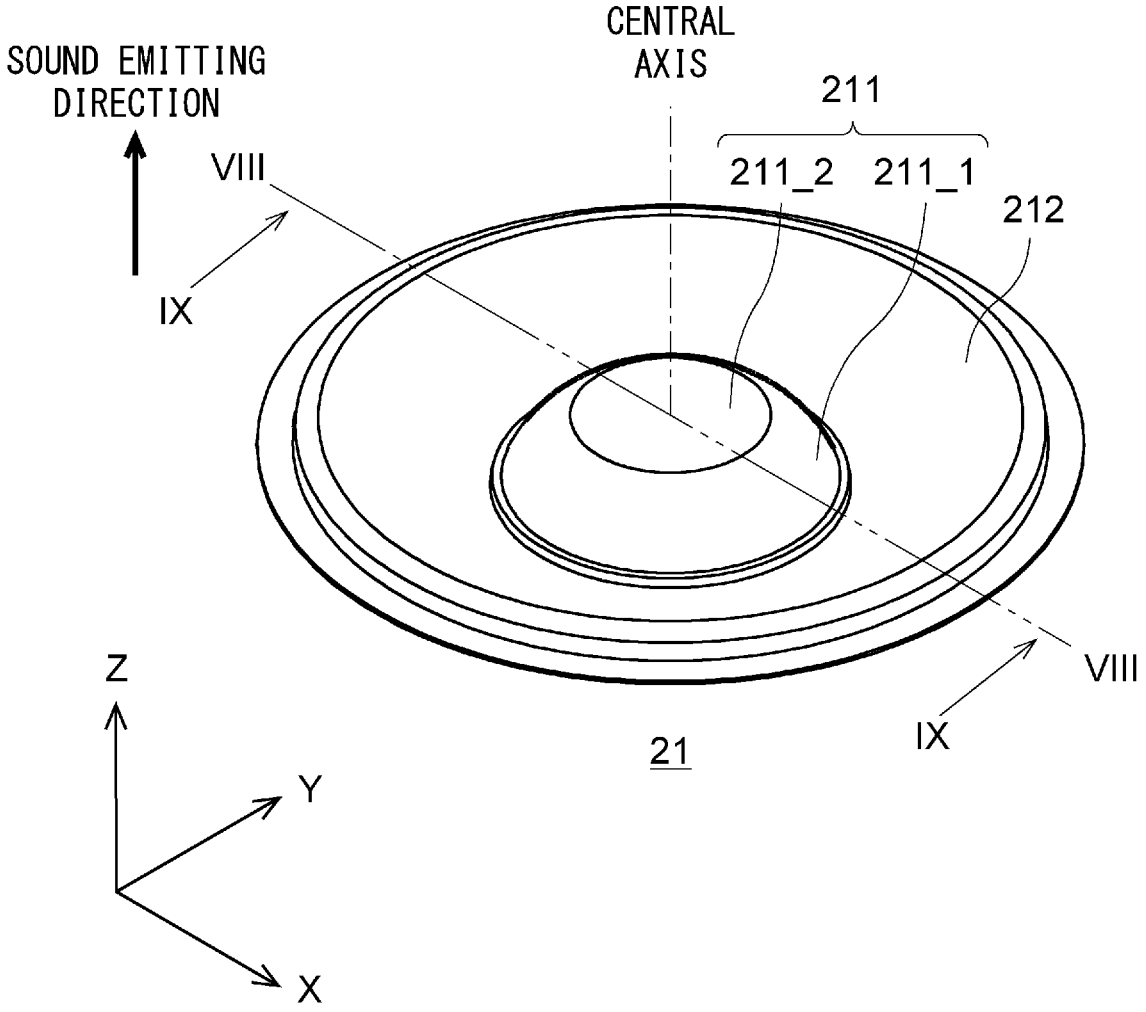
FIG. 7 is a perspective view of a diaphragm according to a second embodiment.
Figure 8:
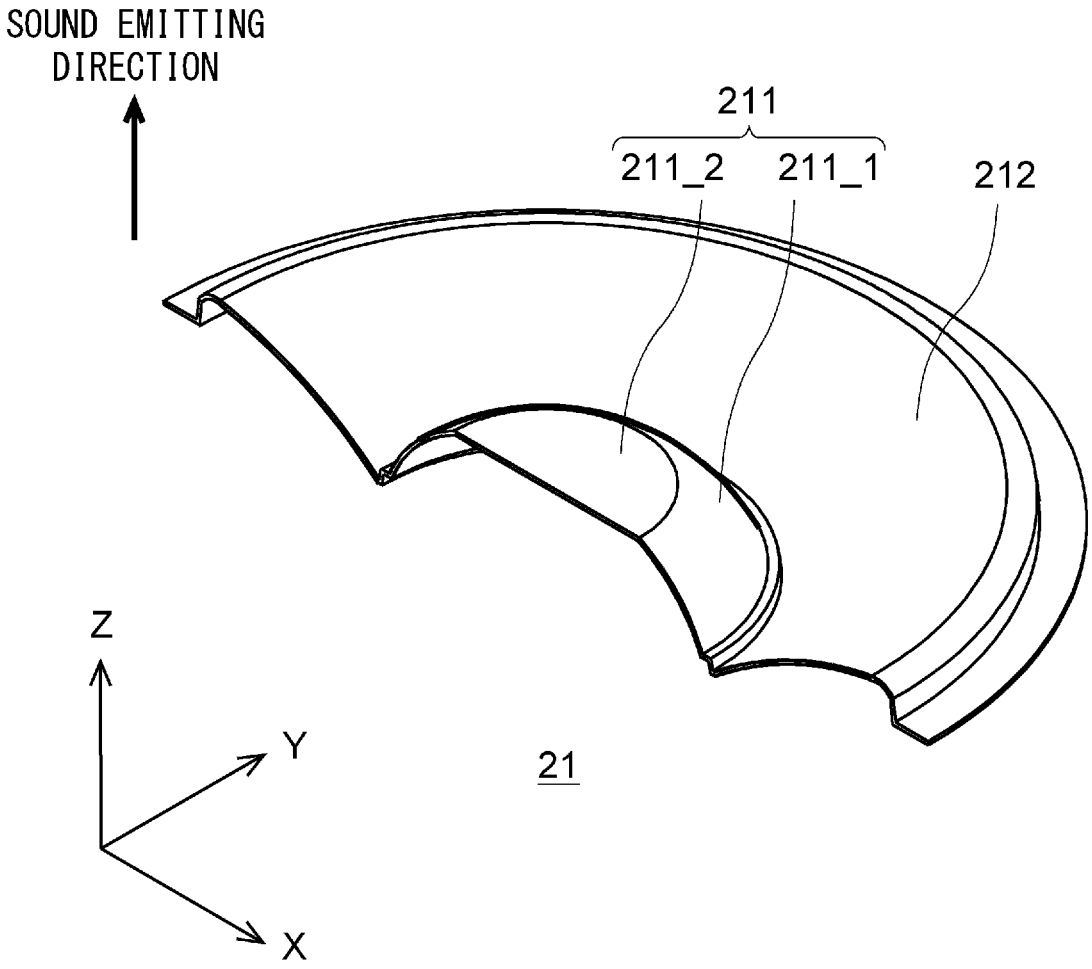
FIG. 8 is a cross-sectional perspective view of the diaphragm according to the second embodiment.
Figure 9:
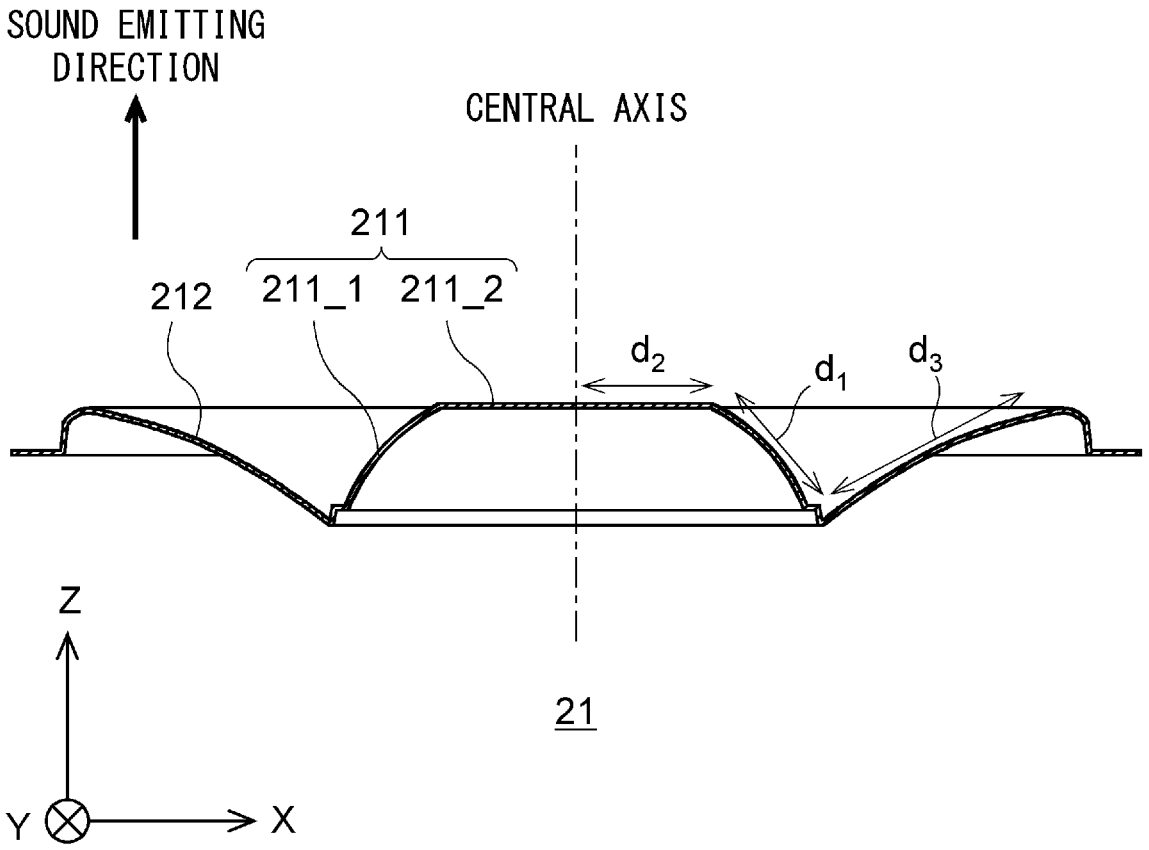
FIG. 9 is a cross-sectional horizontal view of the diaphragm according to the second embodiment.

Next, with reference to FIGS. 7-9, a configuration of a diaphragm 21 according to a second embodiment will be explained. FIG. 7 is a perspective view of the diaphragm 21 according to the second embodiment. FIG. 8 is a cross-sectional perspective view of the diaphragm 21 shown in FIG. 7 taken along the line VIII-VIII. FIG. 9 is a cross-sectional horizontal view of the diaphragm 21 shown in FIG. 7 when it is taken along the line VIII-VIII and it is seen from the Y-axis negative direction side.

The size and the material of the diaphragm 21 are the same as those of the diaphragm 11 according to the first embodiment.

As shown in FIGS. 7-9, the diaphragm 21 includes a dome type diaphragm 211 having a convex shape in the sound emitting direction and a cone type diaphragm 212 that has a concave shape in the sound emitting direction and is provided around the dome type diaphragm 211. That is, the diaphragm 21 is a balanced dome type diaphragm.

The dome type diaphragm 211 includes a first part 211_1 having a convex shape in the sound emitting direction and a planar second part 211_2 that is arranged on an inner side (i.e., an inner peripheral side) of the first part 211_1 and is integrally provided with the first part 211_1. The first part 211_1 has an annular shape when it is seen from the sound emitting direction and the second part 211_2 has a circular shape when it is seen from the sound emitting direction. Both the first part 211_1 and the second part 211_2 are provided concentrically around the central axis when they are seen from the sound emitting direction.

That is, the diaphragm 21 according to the second embodiment is different from the diaphragm 11 according to the first embodiment in that the basic second part 211_2 has a planar shape in the diaphragm 21 according to the second embodiment.

In the second embodiment, the curvature of the second part 211_2 (second curvature) is zero. That is, the second part 211_2 has a flat shape. Therefore, the rigidity of the second part 211_2 with respect to the vibration in the sound emitting direction is lower than the rigidity of the first part 211_1. Accordingly, in the diaphragm 21, three vibration modes, i.e., a mode A in which only the second part 211_2 is likely to vibrate, a mode B in which only the first part 211_1 is likely to vibrate, and a mode C in which both the first part 211_1 and the second part 211_2 are vibrated, appear. Among them, the mode C is a vibration mode of the highest frequency band. In the mode C, both the first part 211_1 and the second part 211_2 are vibrated. Accordingly, the dome type diaphragm 211 is able to output sounds in a high sound area at a high sound pressure.

The surface length in the radial direction (first length $d_1$, see FIG. 9) from the boundary between the first part 211_1 and the second part 211_2 to the end part of the first part 211_1 on a side opposite to the sound emitting direction and the surface length in the radial direction (second length $d_2$, see FIG. 9) from the boundary to the center of the second part 211_2 are preferably equal to each other. In this configuration, the vibration on the side of the first part 211_1 and the vibration on the side of the second part 211_2 in the above mode C are likely to resonate, whereby the sound pressure can be further increased. At this time, the case in which the surface lengths in the radial direction are equal to each other is not limited to a case in which they strictly coincide with each other and also includes a case in which they are approximately close to each other. In short, it is sufficient that they are close to each other as long as the vibration on the side of the first part 211_1 and the vibration on the side of the second part 211_2 in the above mode C are likely to resonate.

Figure 10:
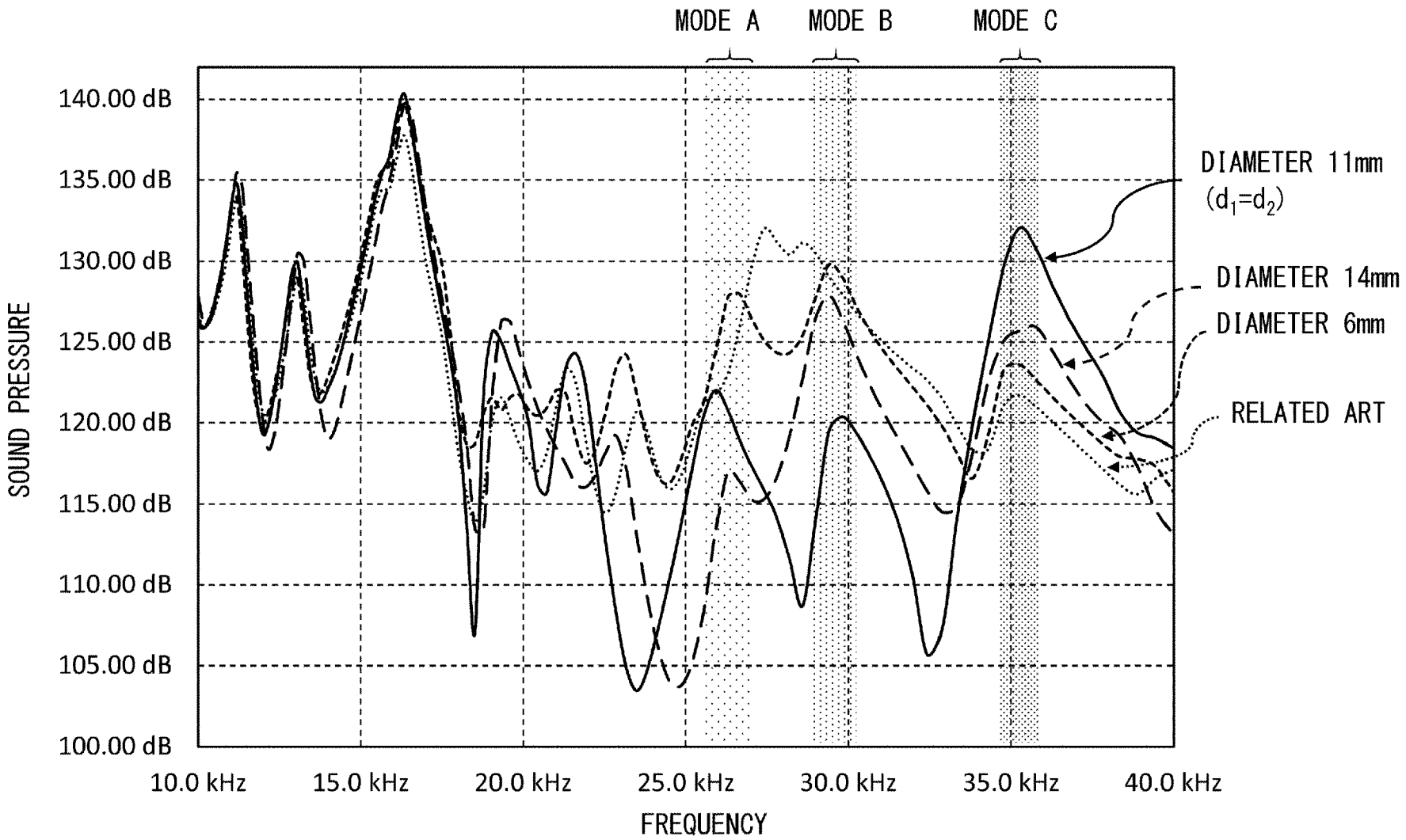
FIG. 10 is a graph indicating sound pressure-frequency characteristics of the diaphragm according to the first embodiment.

FIG. 10 is a graph indicating the sound pressure-frequency characteristics when the diameter of the second part 211_2 is changed to 14 mm, 11 mm, and 6 mm in the dome type diaphragm 211 having a diameter when it is seen from the sound emitting direction of 20 mm. The values in the vertical axis indicate the sound pressure at a place that is away from the diaphragm by 25 cm in the sound emitting direction.

In FIG. 10, the dotted line indicates sound pressure-frequency characteristics of a diaphragm according to related art, and the dashed line, the long dashed line, and the solid line indicate the sound pressure-frequency characteristics of the dome type diaphragm 211 according to this embodiment. Note that the dashed line indicates the sound pressure-frequency characteristics when the diameter of the second part 211_2 is set to 6 mm, the long dashed line indicates the sound pressure-frequency characteristics when the diameter of the second part 211_2 is set to 14 mm, and the solid line indicates the sound pressure-frequency characteristics when the diameter of the second part 211_2 is set to 11 mm. Note that the diaphragm according to the related art here means a balanced dome type diaphragm including a dome type diaphragm having a single curvature and a cone type diaphragm.

As shown in FIG. 10, the sound pressure in the high frequency band at about 35 kHz in the dome type diaphragm 211 is higher than the sound pressure in the diaphragm according to the related art in every case in which the diameter of the second part 211_2 is set to 14 mm, 11 mm, or 6 mm. The above results indicate that the dome type diaphragm 211 according to this embodiment is able to output sounds in a high sound area at a high sound pressure compared to the dome type diaphragm according to related art.

Further, when the sound pressure in the high frequency band at about 35 kHz is focused on, it is found that the sound pressure becomes higher when the diameter of the second part 211_2 is set to be 11 mm than the sound pressure when the diameter of the second part 211_2 is set to be 14 mm or 6 mm. It can be considered that this is because, when the diameter of the second part 211_2 is 11 mm, both the first length $d_1$ (see FIG. 9) and the second length $d_2$ (see FIG. 9) are substantially equal to each other (about 5.2 mm) and the vibration of the first part 211_1 and the vibration of the second part 211_2 are likely to resonate each other.

When the first length $d_1$ is equal to the second length $d_2$, the length in the radial direction of the cone type diaphragm 212 (third length $d_3$, see FIG. 9) is preferably close to the integral multiple (e.g., twice) of the first length $d_1$ or the second length $d_2$. In the above configuration, the vibration on the side of the first part 211_1 and the vibration on the side of the second part 211_2 are likely to resonate, and further the vibration of the cone type diaphragm 212 is likely to resonate. It is therefore possible to further increase the sound pressure.

It is shown in FIG. 10 that the diaphragm 21 has strong vibration peaks in frequency bands of about 25 kHz, about 30 kHz, and about 35 kHz. On the other hand, according to the results of the frequency response analysis, only the second part 211_2 is vibrated in a frequency band of about 25 kHz, only the first part 211_1 is vibrated in a frequency band of about 30 kHz, and both the first part 211_1 and the second part 211_2 are vibrated in a frequency band of about 35 kHz.

The above results support that the frequency bands of about 25 kHz, about 30 kHz, and about 35 kHz respectively correspond to the vibration modes in the mode A, the mode B, and the mode C.

Specific configuration examples of the speaker and the diaphragm according to this embodiment has been described above. The present disclosure is not limited to the above embodiments and may be changed as appropriate without departing from the spirit of the present disclosure.

For example, while the diaphragm that is used for the speaker according to the present disclosure has been described to be a balanced dome type in the above embodiments, it is sufficient that the speaker according to the present disclosure include the dome type diaphragm according to the present disclosure. That is, the speaker according to the present disclosure may not include a cone type diaphragm. According to this configuration as well, the speaker according to the present disclosure is able to output sounds in a high sound area at a high sound pressure.

Further, while the configuration example in which the second curvature is smaller than the first curvature has been described in the above embodiments, the magnitudes of the second curvature and the first curvature are not limited thereto. That is, the second curvature may be larger than the first curvature. According to this configuration as well, the dome type diaphragm according to the present disclosure is able to output sounds in a high sound area at a high sound pressure. However, from the viewpoint of directivity, the second curvature is preferably smaller than the first curvature.

Further, the second part has been described to be a convex or flat plane with respect to the sound emitting direction in the above embodiments, the second part may be a concave plane with respect to the sound emitting direction (i.e., convex in the direction opposite to the sound emitting direction). According to this configuration as well, the dome type diaphragm according to the present disclosure is able to output sounds in a high sound area at a high sound pressure. However, from the viewpoint of directivity, the second part is preferably a convex or flat plane with respect to the sound emitting direction.

Further, while the diaphragm has been described to have a circular shape when it is seen from the sound emitting direction in the above embodiments, the shape of the diaphragm is not limited thereto. That is, the diaphragm may have a polygonal shape or an elliptical shape when it is seen from the sound emitting direction. In this case, the curvature of the diaphragm can be defined to be a reciprocal of the curvature radius along the ridge or a reciprocal of the curvature radius in the short-axis direction.

Further, while the first part and the second part are provided concentrically when they are seen from the sound emitting direction in the above embodiments, the positional relationship of the first part and the second part is not limited thereto. However, from the viewpoint of directivity, the first part and the second part are preferably provided concentrically when they are seen from the sound emitting direction.

When the first part and the second part are not concentric when they are seen from the sound emitting direction, the boundary thereof is not concentric as well. That is, since the length in the radial direction of the first part and that of the second part are changed in the circumferential direction in accordance with the amount of eccentricity and the vibration modes in accordance with their lengths appear, the vibration modes in accordance with their lengths are mixed with low sharpness on the surface of the diaphragm. Accordingly, the sound pressure of one frequency is formed of a plurality of vibration modes, whereby smoother sound pressure frequency characteristics in which peak dip is suppressed are obtained.

It has been described in the above second embodiment that the surface length in the radial direction from the boundary between the first part and the second part to the end part of the first part on the side opposite to the sound emitting direction (first length) and the surface length in the radial direction from the boundary to the center of the second part (second length) are preferably equal to each other. This relationship is not limited, however, to the case in which the second part has a planar shape. That is, the above first length and the above second length are preferably equal to each other also in a case in which the second part has a convex shape or a concave shape in the sound emitting direction.

While the first part has a convex shape in the sound emitting direction in the embodiments of the present disclosure, the effects of the present disclosure can be obtained also in a case in which the first part has a convex shape in the opposite direction with respect to the sound emitting direction.

While the invention has been described in terms of several embodiments, those skilled in the art will recognize that the invention can be practiced with various modifications within the spirit and scope of the appended claims and the invention is not limited to the examples described above.

Further, the scope of the claims is not limited by the embodiments described above.

Furthermore, it is noted that, Applicant's intent is to encompass equivalents of all claim elements, even if amended later during prosecution.

What is claimed is:

1. A dome type diaphragm comprising:

a first part having a first curvature and is arranged in an inner peripheral side of a bobbin, the first part configured to be in contact with the bobbin and transmit vibration directly from the bobbin;

a second part that is arranged in an inner peripheral side of the first part and is integrally provided with the first part, the second part having a second curvature that is different from the first curvature and to which the vibration from the bobbin is transmitted via the first part, and the second part having a second rigidity that is smaller than a first rigidity of the first part; and a boundary part, that is a change point between the first rigidity and the second rigidity, is provided between the first part and the second part, wherein the dome type diaphragm is formed as a single dome shape by combining the first part and the second part and a height of an outer peripheral portion of the first part and a height of an outer peripheral portion of the second part are different in a sound emitting direction.

2. The dome type diaphragm according to claim 1, wherein the second curvature is smaller than the first curvature.

3. The dome type diaphragm according to claim 1, wherein the first part has a convex shape, and the second part has a convex shape in a direction that is the same as a direction in which the first part is protruded.

4. The dome type diaphragm according to claim 1, wherein the first part has a convex shape, and the second part has a flat shape.

5. The dome type diaphragm according to claim 1, wherein the first part has an annular shape when it is seen from a sound emitting direction of the dome type diaphragm, and the second part has a circular shape when it is seen from the sound emitting direction.

6. The dome type diaphragm according to claim 5, wherein the first part and the second part are provided concentrically when they are seen from the sound emitting direction.

7. The dome type diaphragm according to claim 6, wherein a surface length in a radial direction from a boundary between the first part and the second part to an end part of the first part on a side opposite to the sound emitting direction is equal to a surface length in the radial direction from the boundary to a center of the second part, and the boundary part has:

a first vibration mode in which the first part and the second part resonate, a second vibration mode in which the second part resonates and the first part does not resonate, and a third vibration mode in which the first part resonates and the second part does not resonate.

8. A balanced dome diaphragm comprising:

the dome type diaphragm according to claim 1; and a cone type diaphragm.

9. A speaker comprising the balanced dome diaphragm according to claim 8.

10. A speaker comprising the dome type diaphragm according to claim 1.

11. The dome type diaphragm according to claim 1, wherein the vibration from the bobbin is transmitted to the second part via the first part and the boundary part is a mechanical filter for the vibration.

* * * * *